United States Patent [19]

Roberts

[11] 4,109,497

[45] Aug. 29, 1978

[54] KEY CONSTRUCTION

[76] Inventor: Marvin E. Roberts, 2305 S. Arlington Ave., Reno, Nebr. 89509

[21] Appl. No.: 810,506

[22] Filed: Jun. 27, 1977

Related U.S. Application Data

[63] Continuation-in-part of Ser. No. 671,010, Mar. 26, 1976, abandoned, which is a continuation of Ser. No. 505,367, Sep. 12, 1974, abandoned.

[51] Int. Cl.[2] ..... E05B 19/02

[52] U.S. Cl. ..... 70/403; 70/366

[58] Field of Search ..... 70/365, 366, 376, 377, 70/403, 402, 406, 409, 411

[56] References Cited

U.S. PATENT DOCUMENTS 2,123,940 7/1938 Gray ..... 70/364 R

FOREIGN PATENT DOCUMENTS 1,555,343 12/1968 France ..... 70/377

*Primary Examiner*—Robert L. Wolfe

[57] ABSTRACT

A key construction for use with a rotary disc-tumbler lock wherein the key has a shank portion and a bow or other rotating means on one end thereof. The key shank is formed with a vee-groove longitudinally thereof which vee-groove permits insertion and retraction of the key shank into the lock without disturbing the position of the tumblers in the lock. Further, the shank of the key being formable with warding grooves extending along the shank.

5 Claims, 7 Drawing Figures

KEY CONSTRUCTION

This is a continuation-in-part of application, Ser. No. 671,010, filed Mar. 26, 1976 and now abandoned which is a continuation of application, Ser. No. 505,367, filed Sept. 12, 1974, abandoned.

BACKGROUND OF THE INVENTION

Lock cylinders with rotary disc tumblers have proven superior in the prevention of serruptitious entry means. This type of cylinder is gaining wide acceptance due to the relative ease of picking other types of cylinders.

The design and manufacture of keys of unique construction is a desirable element in the advancement of the art.

Unique key constructions that will operate bi-directional rotary disc-tumbler cylinders as in Roberts, et al U.S. Pat. No. 3,789,638 are in demand and will advance the state of the art as to this type of cylinder.

SUMMARY OF THE INVENTION

This invention provides a key construction for use with a rotary disc-tumbler lock cylinder and in particular for use with such a cylinder that is operable in both direction from the locked position by the same key.

This invention further provides a key construction in the preceeding paragraph and that has warding grooves therein serving to provide keys with differing sectional configurations so as to provide keys with differing insertion restrictions.

OBJECTS OF THE INVENTION

It is an object of the invention to provide an improved key for the operation of a bidirectional rotary disc-tumbler lock cylinder wherein the key may be inserted into or withdrawn from the lock cylinder without disturbing the tumblers in the cylinder.

It is a further object of the invention to provide an improved key for the operation of a bidirectional rotary disc-tumbler lock cylinder with warding grooves along the shank of the key formable in a plurality of configurations and angular positions so as to provide restrictive sections thus preventing the key from being inserted into cylinders that have not been adapted to receive keys of that section.

It is a further object of the invention to provide an improved key construction for use in conjunction with rotary disc-tumbler locks wherein the key is simple and economical to manufacture.

The foregoing and other objects of the invention will become more readily evident from the following detailed description of a preferred embodiment when considered in conjunction with the accompanying drawings.

DESCRIPTION OF THE PREFERRED EMBODIMENT

Figure 1:
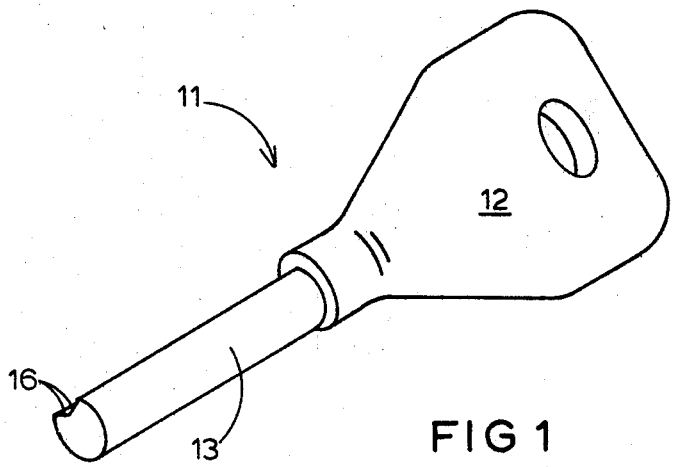
FIG. 1 is an isometric view of a key.

Referring to FIG. 1, a key 11 of the type to be used in cooperation with a rotary disc-tumbler lock cylinder, said key having a bow 12 or other torquing means, shank portion 13, and formed along shank portion 13 a two sided vee-groove 16.

The shank portion 13 is formed as in a generally circular cylindrical shape. Vee-groove 16 is formed radially inwardly of the shank portion 13 to a depth less than the major radius of shank 13.

Figure 2:
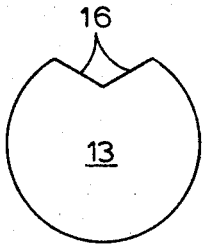
FIG. 2 is an end view of the shank of the key in FIG. 1.
Figure 3:
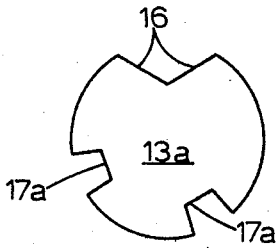
FIGS. 3, 4, 5, 6 and 7 are end views of the shanks of various keys similar to FIG. 2 and with warding grooves of different positions and shapes formed thereinto.
Figure 4:
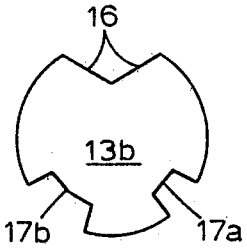
Figure 5:
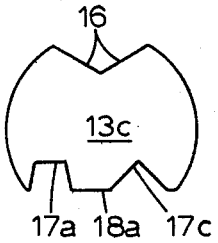
Figure 6:
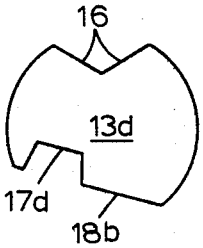
Figure 7:
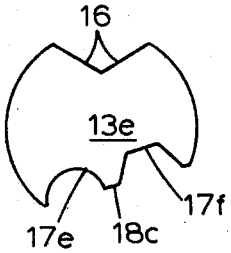

The cross sectional shape of shank 13 of key 11, prior to wardings being formed thereinto, is best shown in FIG. 2. The vee-groove 16 extends the length of shank 13 prior to bittings being formed into shank 13. The vee-groove 16 permits the free insertion and withdrawal of the shank 13 in its associated cylinder without disturbing the tumblers in said cylinder.

FIGS. 3, 4, 5, 6 and 7 are cross-sectional views of shanks 13*a* through 13*e* that are similar to the view in FIG. 2. Shanks 13*a* through 13*e* having been formed in addition to vee-groove 16 with warding grooves 17*a* through 17*f* and or warding planes 18*a* through 18*c*.

All of warding grooves 17*a* through 17*f* and warding planes 18*a* through 18*c* extend radially into the shank portion 13 and when formed thereinto result in shank cross-sectional configurations such as 13*a* through 13*e*.

Warding grooves 17*a* through 17*f* and warding planes 18*a* through 18*c* when formed into shank 13 extend longitudinally along shank 13 parallel to the rotational axis thereof.

Any one shank 13 may be formed with one or more warding grooves as for example 17*a* through 17*f* and or one or more warding planes, as for example, 18*a* through 18*c*.

Key shanks when formed with warding grooves and or warding planes as described above are thereby provided with unique cross-sectional configurations that permit insertion of the shank into lock cylinders when the key hole of the cylinder has a corresponding shape and restricts the insertion of the shank into cylinder key holes that are not correspondingly shaped.

I claim:

1. A key construction prior to code bittings being formed thereinto, said key having a generally circular cylindrical shank, said shank being formed with a vee-shaped groove thereinto, see vee-groove being formed with two sides intersecting in a substantially straight line at the base of said vee-groove, said vee-groove being formed longitudinally along said shank parallel to the axis thereof, said vee-groove having a depth radially into said shank less than the major radius of said shank.

2. A key construction according to claim 1, said shank being formed with one or more warding grooves and or warding planes longitudinally parallel to the rotational axis of said shank, said warding grooves and or warding planes being formed radially inwardly of said shank, said shank being formable by said warding grooves and or warding planes in anyone of a plurality of cross-sectional configurations.

3. A key construction prior to code bittings being formed thereinto, said key having a generally circular cylindrical shank, said shank being formed with a vee-shaped groove thereinto, said vee-groove being formed with two sides intersecting in a substantially straight line at the base of said vee-groove, said vee-groove being formed longitudinally along said shank parallel to the axis thereof, said vee-groove having a depth radially into said shank less than the major radius of said shank, the sides of said vee-groove being coincidental with the lesser portions of two intersectiong chordal planes through said shank, said chordal planes being offset from but parallel to the longitudinal axis of said shank, the area of any cross-section taken transversely of said shank being less than the area of a circle whose radius is equal to the major radius of said shank.

4. A key construction according to claim 3, said shank being formed with one or more warding grooves and or warding planes longitudinally parallel to the rotational axis of said shank, said warding grooves and or warding planes being formed radially inwardly of said shank, said shank being formable by said warding grooves and or warding planes in anyone of a plurality of cross-sectional configurations.

5. A key construction, said key having a generally circular cylindrical shank, said shank being formed with a vee-shaped groove thereinto, said vee-groove being formed with two sides intersecting in a substantially straight line at the base of said vee-groove, said vee-groove being formed longitudinally along said shank parallel to the axis thereof, said vee-groove having a depth radially into said shank less than the major radius of said shank, said shank being formed with one or more warding grooves and or warding planes longitudinally parallel to the rotational axis of said shank, said warding grooves and or warding planes being formed radially inwardly of said shank, said shank being formable by said warding grooves and or warding planes in anyone of a plurality of cross-sectional configurations, the area of any cross-section taken transversely of said shank being less than the area of a circle whose radius is equal to the major radius of said shank.

* * * * *